US005255341A

United States Patent [19]

Nakajima

[11] Patent Number: 5,255,341

[45] Date of Patent: Oct. 19, 1993

[54] COMMAND INPUT DEVICE FOR VOICE CONTROLLABLE ELEVATOR SYSTEM

[75] Inventor: Yutaka Nakajima, Tokyo, Japan

[73] Assignee: Kabushiki Kaisha Toshiba, Kawasaki, Japan

[21] Appl. No.: 934,305

[22] Filed: Aug. 26, 1992

Related U.S. Application Data

[63] Continuation of Ser. No. 564,614, Aug. 9, 1990, abandoned.

[30] Foreign Application Priority Data

Aug. 14, 1989 [JP] Japan ..... 1-207983

[51] Int. Cl.[5] ..... G10L 5/00

[52] U.S. Cl. ..... 395/2; 340/573

[58] Field of Search ..... 395/2; 381/41-51; 340/435, 573, 686; 187/28, 100, 121, 139

[56] References Cited

U.S. PATENT DOCUMENTS

| | | | |
|---|---|---|---|
| 3,764,819 | 10/1973 | Muller | 340/573 |
| 3,836,714 | 9/1974 | Pomper et al. | 381/46 |
| 4,001,613 | 1/1977 | Hills et al. | 340/573 |
| 4,363,029 | 12/1982 | Piliavin et al. | 340/686 |
| 4,449,189 | 5/1984 | Feix et al. | 381/42 |
| 4,534,056 | 8/1985 | Feilchenfeld et al. | 381/42 |
| 4,558,298 | 12/1985 | Kawai et al. | 187/121 |
| 4,558,459 | 12/1985 | Noso et al. | 381/43 |
| 4,590,604 | 5/1986 | Feilchenfeld | 381/42 |
| 4,897,630 | 1/1990 | Nykerk | 381/51 |
| 5,003,293 | 3/1991 | Wu | 340/573 |

FOREIGN PATENT DOCUMENTS

| | | |
|---|---|---|
| 52-123057 | 10/1977 | Japan . |
| 1-247378 | 10/1989 | Japan . |

*Primary Examiner*—David D. Knepper

*Attorney, Agent, or Firm*—Foley & Lardner

[57] ABSTRACT

A command input device to be used in a voice controllable elevator system, capable of enabling a user to perform a command input in voice more easily and accurately. The device includes a sensor for detecting presence of the user within a prescribed proximity to a microphone; and a unit for outputting the command recognized by a speech recognition unit to an elevator control unit of the elevator system in response to termination of detection of the user by the sensor. In addition, the speech recognition unit recognizes the last command given by the user while the sensor is detecting the presence of the user. The user can correct a command incorrectly recognized by the speech recognition unit by re-entering the command while the sensor is detecting the presence of the user.

13 Claims, 4 Drawing Sheets

COMMAND INPUT DEVICE FOR VOICE CONTROLLABLE ELEVATOR SYSTEM

This application is a continuation, of application Ser. No. 07/564,614, filed Aug. 9, 1990, now abandoned.

BACKGROUND OF THE INVENTION

1. Field of the Invention

The present invention relates to a voice controllable elevator system which operates by commands given in voices, instead of usual manual commands, and more particularly, to a command input device for such a voice controlled elevator which allows inputs of commands in terms of voices.

2. Description of the Background Art

A usual conventional elevator system found in various buildings is normally operated by a user manually. The manual control operations to be performed by a user include:

(1) pressing of a elevator call button at a hallway, (2) pressing of a destination call button in an elevator car, and (3) pressing of a door open/close button in an elevator car, in response to which the elevator carries out the specified functions.

Now, the various control buttons provided in such a conventional elevator system are not necessarily convenient for some situations. For instance, for a user carrying some objects by both hands, it is often necessary to put these objects on a floor first, and then press the correct button to control the elevator, which is a rather cumbersome procedure. Also, for a blind person, it is a very cumbersome task to find tiny buttons. Another awkward situation is a case in which someone else is standing in front of the control buttons.

As a solution to such inconveniences associated with a conventional elevator system, a voice controllable elevator system which can be operated by commands given in voices instead of usual manual commands has been proposed.

In such a voice controllable elevator system, a microphone for receiving commands given in voices is provided in a hallway, in place of a usual elevator call button, and a speech recognition process is carried out for the voices collected by this microphone, such that the commands given in voices are recognized and the elevator system is operated in accordance with the recognized commands. For instance, when a user said "fifth floor", this command is recognized, and in response to this command a call response lamp for the fifth floor is lit and the elevator moves to the fifth floor, just as if the destination call button for the fifth floor is manually operated in a usual conventional elevator system.

The speech recognition process utilizes a number of words registered in advance in a form of a dictionary, so that the input speech is frequency analyzed first and then the result of this frequency analysis is compared with registered word data in the dictionary, where the words are considered as being recognized when a similarity between the result of the frequency analysis and the most closely resembling word of the registered word data is greater than a certain threshold level. For such a speech recognition process, a type of speech recognition technique called non-specific speaker word recognition is commonly employed, in which a speaker of the speech to be recognized is not predetermined.

The recognition is achieved in units of individual words, such as "open", "close", "door", "fifth", "floor", etc.

Now, such a voice controllable elevator system is associated with a problem of reduced recognition rate, due to the fact that the dictionary is normally prepared at a quite noiseless location at which over 90% of recognition rate may be obtainable. An actual location of the elevator system is much noisier.

To cope with this problem, it is custom to set up a threshold loudness level for the command inputs, such that the recognition is not effectuated unless the loudness of the voice input reaches this threshold loudness level, in hope of distinguishing actual commands and other noises at a practical level.

FIG. 1 shows an example of a command input device for such a conventional voice controllable elevator system, located at an elevator hallway. In FIG. 1, a elevator location indicator 102, elevator call buttons 103, and a microphone 104 are arranged in a vicinity of an elevator door 101. When a user gives some commands in voice toward this microphone 104, the commands are recognized and the elevator system is operated in accordance with the recognized commands.

However, even with over 90% recognition rate, there is a considerable chance for wasteful and undesirable false functioning of the elevator system due to false speech recognition, compared to a conventional manually controllable elevator system. Also, when a user gives a command in a form not registered in the dictionary, such as "shut the door", "let me in", and "let me out", the elevator system is non-responsive.

Moreover, in a so called group administration elevator system in which a plurality of elevators are administered as a group such that whenever an elevator call is issued, a most convenient one of these elevators is selected and reserved for this call immediately, the false functioning of the elevator system due to one false shape recognition from one user may causes disturbances to other users.

SUMMARY OF THE INVENTION

It is therefore an object of the present invention to provide a command input device for a voice controllable elevator system, capable of enabling a user to perform a command input in voice more easily and accurately.

According to one aspect of the present invention there is provided a command input device for a voice controllable elevator system operated by an elevator control unit, comprising: microphone means for receiving a command given by a user in voice; speech recognition means for recognizing the command; sensor means for detecting a presence of the user within a prescribed proximity to the microphone means; and means for outputting the command recognized by the speech recognition means to the elevator control unit of the elevator system, in response to the termination of detection of the presence of the user by the sensor means.

According to another aspect of the present invention there is provided a command input device for a voice controllable elevator system operated by an elevator control unit, comprising: microphone means for receiving a command given by a user in voice; speech recognition means for recognizing the command, which recognizes a last command given by the user during a period of time in which the microphone means and the speech recognition means are operative, in a case more than one command are received by the microphone means; and means for outputting the command recognized by the speech recognition means to the elevator control unit of the elevator system.

Other features and advantages of the present invention will become apparent from the following description taken in conjunction with the accompanying drawings.

DETAILED DESCRIPTION OF THE PREFERRED EMBODIMENTS

Figure 1:
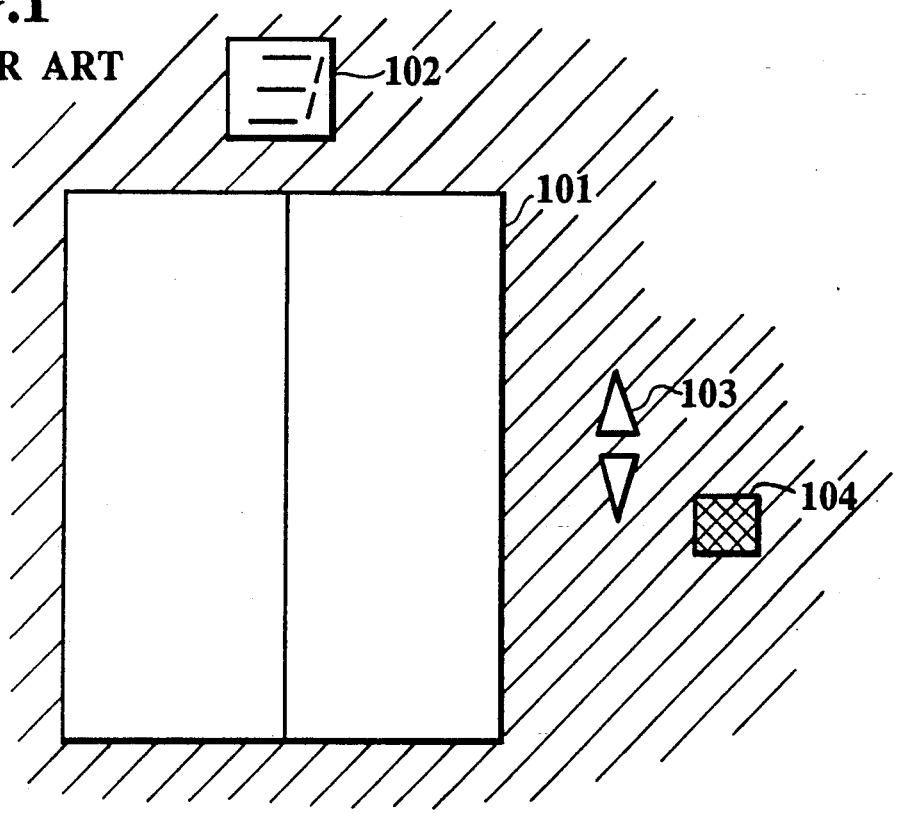
FIG.1 PRIOR ART
FIG. 1 is an illustration of an example of a command input device of a conventional voice controllable elevator system.
Figure 2:
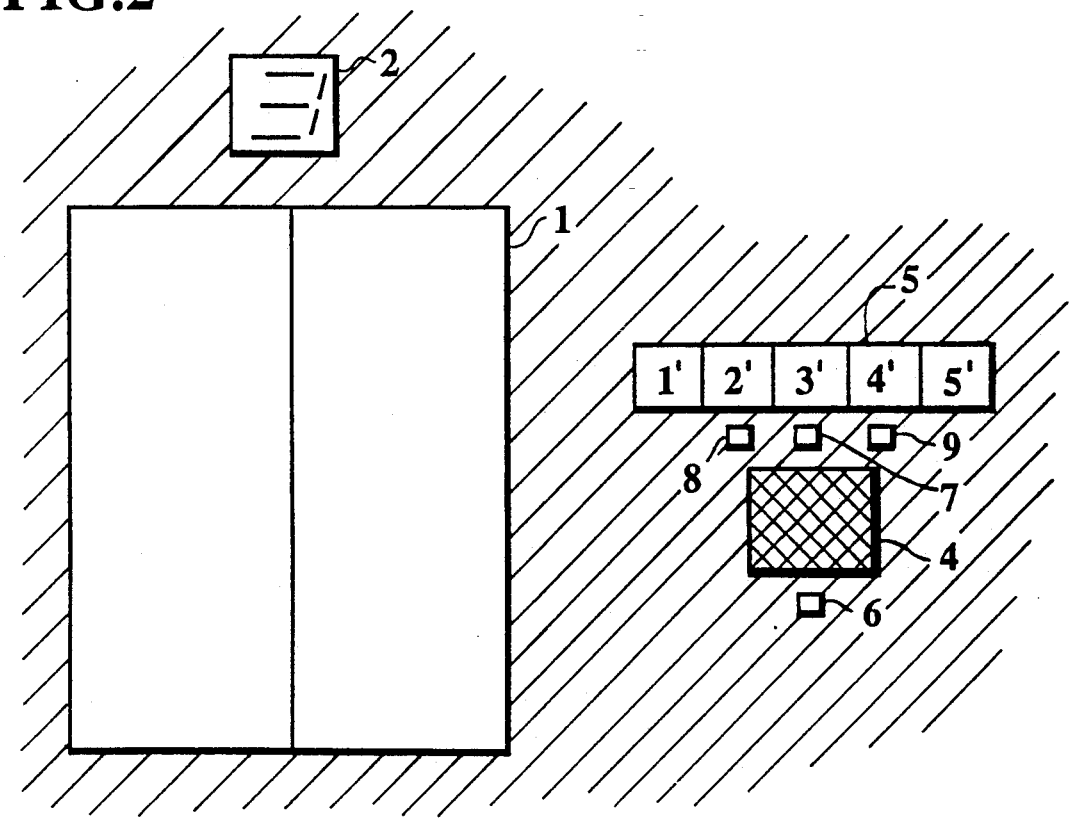
FIG. 2 is an illustration of one embodiment of a command input device for a voice controllable elevator system according to the present invention.

Referring now to FIG. 2, there is shown one embodiment of a command input device for a voice controllable elevator system according to the present invention, located at an elevator hallway.

In this embodiment, a destination floor is also specified at the elevator hallway at a time of elevator call, so that a user does not need to give a destination call inside an elevator car.

In FIG. 2, above an elevator door 1, there is an elevator location indicator 2 for indicating a present location of an elevator car. Also, adjacent to the elevator door 1, there is arranged a microphone 4 for receiving commands given in voice, a destination floor indicator lamp 5 for indicating a destination floor registered by a user, which also function as destination call buttons to be manually operated, a user detection sensor 6 located nearby the microphone 4 for detecting a presence of the user in a prescribed proximity sufficient for performing a satisfactory speech recognition, a sensor lamp 7 for indicating that a command input by voice is possible, i.e., the user is within the prescribed proximity so that the speech recognition process can be performed, an OK lamp 8 for indicating a success of a registration of a command given in voice, and a rejection lamp 9 for indicating a failure of a registration of a command given in voice.

Figure 3:
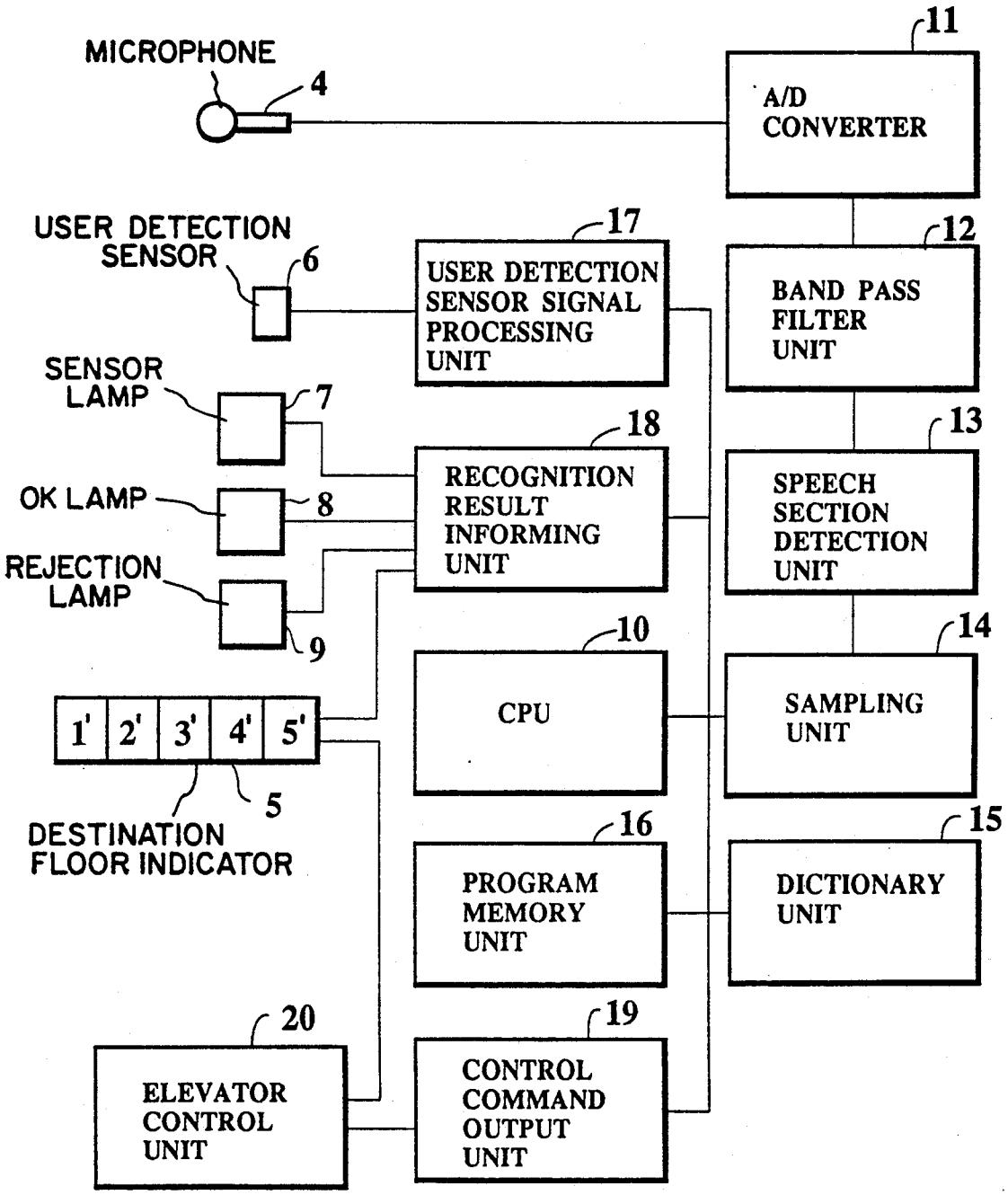
FIG. 3 is a schematic block diagram for the command input device of FIG. 2.

In detail, as shown in FIG. 3, this command input device further comprises a CPU 10 for controlling operations of other elements of the command input device, an A/D converter 11 for converting analog signals of an input speech collected by the microphone 4 into digital signals in accordance with the amplitudes of the analog signals, a band pass filter unit 12 for providing a filter to the digital signal from the A/D converter 11, a speech section detection unit 13 for detecting a speech section in the filtered digital signals from the band pass filter unit 12, a sampling unit 14 for sampling speech recognition data from the speech portion of the filtered digital signals obtained by the speech section detection unit 13, a dictionary unit 15 for registering a selected number of words to be recognized in advance, a program memory unit 16 for memorizing a program for operations to be performed by the CPU 10, a user detection sensor signal processing unit 17 for processing signals from the user detection sensor 6, a recognition result information unit 18 for activating the sensor lamp 7, OK lamp 8, and rejection lamp 9 in accordance with a result of the speech recognition, a control command output unit 19 for outputting the command recognized by the speech recognition to an elevator control unit 20 of the elevator system.

The user detection sensor 6 is made of a dark infrared sensor of diffusive reflection type, so that the user can be detected without distracting an attention of the user too much. The output signals of the user detection sensor 6 are usually about 4 to 20 mA indicating a distance to the user standing in front of the microphone 4, and are converted at the user detection sensor processor 17 into 8 bit digital signals suitable for processing at the CPU 10.

The sensor lamp 7, OK lamp 8, and rejection lamp 9 are arranged collectively as shown in FIG. 2, so that the user standing in front of the microphone 4 can view them altogether.

The sensor lamp 7 is turned on by the recognition result informing unit 18 when the CPU 10 judges that the user is within the prescribed proximity sufficient for the speech recognition process, according to the output signals of the user detection sensor 6.

The OK lamp 8 is turned on for few seconds by the recognition result informing unit 18 when a similarity obtained by the speech recognition process is over a predetermined threshold similarity level, while the rejection lamp 9 is turned on for few seconds by the recognition result informing unit 18 when a similarity obtained by the speech recognition process is not over a predetermined threshold similarity level.

When the similarity obtained by the speech recognition process is over the predetermined threshold similarity level, the CPU 10 also flashes an appropriate destination call button of the destination floor indicator lamp 5 corresponding to the recognition result, so that the user can inspect the recognition result.

The destination call buttons of the destination floor indicators are normally controlled by the signals from the elevator control unit 20, as they are operated by logical OR of the signals from the elevator control unit 20 and the signals indicating the recognition result from the recognition result informing unit 18. Thus, the elevator control unit 20 in this embodiment can be identical to that found in a conventional elevator system.

The signals from the CPU 10 to control the flashing of the destination call button of the destination floor indicator lamp 5 is the same as the signals from the control command output unit 19 to the elevator control unit 20 in a conventional elevator system configuration, which usually have 0.5 second period of on and off states.

The pressing of the destination call button of the destination floor indicator lamp 5 by the user overrides the flashing state, so that when the user presses any one of the destination call button of the destination floor indicator lamp 5 is flashing while one of the destination call button of the destination floor indicator lamp 5 is flashing, the flashing stops and one pressed by the user is turned on stably.

The band pass filter unit 12 provides a limitation on a bandwidth on the digital signals from the A/D converter 11, so as to obtain 12 bit digital signals of 12 KHz sampling frequency. The information carried by these digital signals are compressed by converting the signals into spectral sequences of 8 msec. periods, so as to extract the feature of the speech alone.

The speech section detection unit 13 distinguishes a speech section and non-speech section, and extracts the speech data to be recognized.

The sampling unit 14 normalizes the extracted speech data so as to account for individuality of articulation. Here, the speech data are converted into 256 dimensional vector data and are compared with registered word data in the dictionary unit 15 which are also given in terms of 256 dimensional vector data. The calculation of the similarity between the extracted speech data and the registered word data is carried out by the CPU 10, and a word represented by the registered word data of the greatest similarity level to the extracted speech data is outputted to the control command output unit 19 as the recognition result.

The control command output unit 19 can be made from a usual digital output circuit.

The operation of this command input device will now be described in detail.

When not using the voice command input, users may press the destination call buttons of the destination floor indicator lamp 5 to specify desired destination calls, in response to which the pressed destination call buttons light up. When the elevator car arrives, the specified destination calls are transferred to the elevator car as elevator car calls automatically, so that users can be carried to the desired destination floors.

When using the voice command input, the user approaches the microphone 4. When the user detection sensor 6 detects the user within the prescribed proximity sufficient for carrying out the speech recognition, which is normally set to about 30 cm, the sensor lamp 7 lights up to urge the user to specify by voice a desired destination.

In this state, when the user specifies the desired destination by voice, the speech recognition process is carried out. Either the OK lamp 8 lights up to indicate that the command is recognized, or the rejection lamp 9 lights up to indicate that the command is not recognized.

The OK lamp 8 will light up whenever the similarity over the predetermined threshold similarity level is obtained as the recognition result upon a comparison of the input speech and the registered word data in the dictionary unit 15. Thus, even when the input speech given by the user was "fourth floor" and the recognized command obtained by the CPU 10 was "fifth floor" by mistake, the OK lamp 8 still lights up.

For this reason, the user is notified of the recognized command by the flashing of a corresponding one of the destination call buttons of the destination floor indicator lamp 5, and urged to inspect the recognized command.

When the user confirmed that the recognized command is correct by eye inspection, the user moves away from the microphone 4, and when the user detection sensor 6 detects that the user is outside the prescribed proximity, the recognized command is send from the control command output unit 19 to the elevator control unit 20 as the command input, and the flashing of the destination call button changes to steady lighting to indicate that the command is registered.

In further detail, the speech recognition process is carried out as follows.

Figure 4:
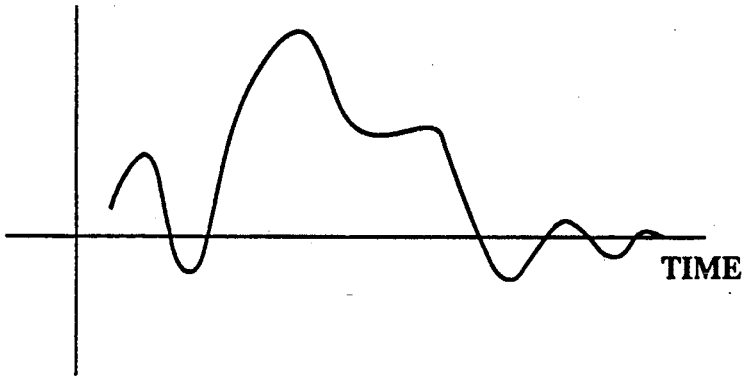
FIGS. 4(A), 4(B), and 4(C) are diagrams explaining speech recognition utilized in the command input device of FIG. 2.
Figure 4:
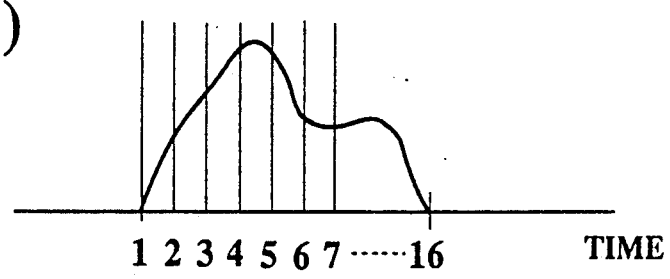
Figure 4:
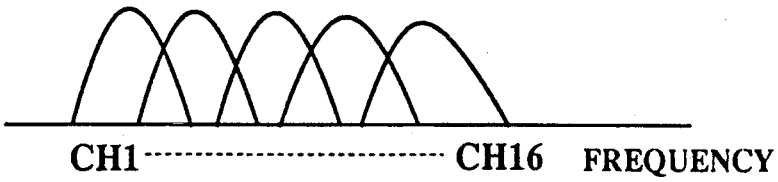

Input speech of the user has a power spectrum, such as that shown in FIG. 4(A), which contains various noises along with the words to be recognized. From such an input speech, the speech section representing the words to be recognized is extracted as shown in FIG. 4(B). This extraction cannot be performed correctly in the presence of loud noise, in which case recognition may be unsuccessful, or a false recognition result may be obtained. For this reason, in this embodiment, if a new input command is given while the sensor lamp 7 is still lit, i.e., while the user is within the prescribed proximity, the later input command replaces the older, such that the speech recognition process will be applied to this newer or later input command. This allows the user to correct the command when the recognized command is found incorrect upon inspection.

In this speech recognition process, the input speech is converted into 16 channel band frequency data, such as those shown in FIG. 4(C).

Figure 5:
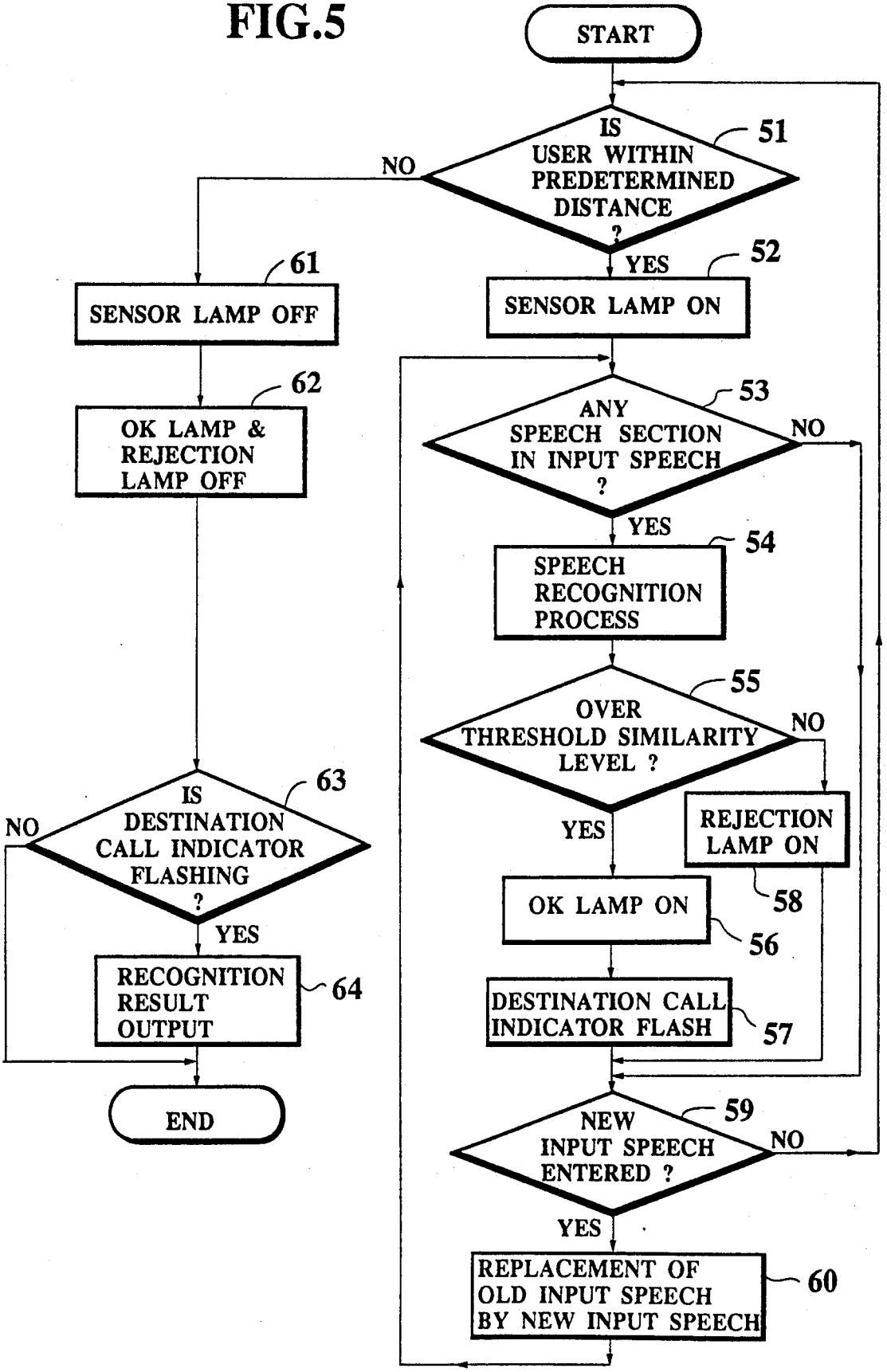
FIG. 5 is a flow chart of the operation of the command input device of FIG. 2.

The operation described above can be performed in accordance with the flow charts of FIG. 5, as follows.

First, at the step 51, whether a distance between the user detection sensor 6 and the user is within the predetermined threshold distance of 30 cm is determined, in order to judge whether the user is within the prescribed proximity sufficient for the speech recognition process to be performed. If the distance to the user is within the predetermined threshold distance, then the step 52 will be taken next, whereas otherwise the step 61 will be taken next, which will be described below.

At the step 52, the sensor lamp 7 is turned on (i.e., lit up) to urge the user to specify the desired command, in voice.

Then, at the step 53, whether any speech section can be found in the input speech by the speech section detection unit 13 is determined, so as to judge whether an input command has been entered. If the speech section can be found in the input command, then the step 54 will be taken, whereas otherwise the step 59, to be described below will be taken.

At the step 54, the speech recognition process is performed on the detected speech section of the input speech, in a manner already described in detail above.

Then, at the step 55, whether the similarity obtained by the speech recognition process at the step 54 is greater than a predetermined threshold similarity level is determined, so as to judge whether the speech recognition has been successful. If the obtained similarity is greater than the predetermined threshold similarity level, then next at the step 56, the OK lamp 8 is turned on (i.e., lit up) in order to notify the user of the success of speech recognition, and at the step 57, one of the destination call buttons corresponding to the recognized command is flashed in order to indicate the recognized command to the user for the purpose of inspection. On the other hand, if the obtained similarity is not greater than the predetermined threshold similarity level, then next at the step 58, the rejection lamp 7 is turned on (i.e., lighted up) in order to notify the user about the failure of the speech recognition.

Here, after the failure of the speech recognition process at the step 58 or after the completion of the speech recognition process at the step 57 where the recognized command is found incorrect by inspection, a correction of the input speech can be made by the user by entering of a new input speech while the sensor lamp 7 is still on (i.e., while remaining within the prescribed proximity from the user detection sensor 6).

This in achieved by first determining, at the step 59, whether there has been a new input speech entered through the microphone 4 while the sensor lamp 7 is on. If there has been another input speech entered, then the old input speech is replaced by the new input speech at the step 60, and the process returns to the step 53 described above to repeat the speech recognition process with respect to the new input speech. On the other hand, if there has not been a new speech, then at the process returns to the step 51 above. In this manner, the user is asked to enter the input speech until the correct command input is recognized.

When the obtained result is found to be correct by the inspection, the user should go away from the user detection sensor 6, so as to be outside the prescribed proximity such that the further speech recognition becomes impossible.

Subsequently, at the step 51, after then the user detection sensor 6 detects that the distance to the user is not within the predetermined threshold distance at the step 51, then the step 61, the sensor lamp 7 is turned off, and at the step 62, the OK lamp 8 and the rejection lamp 9 are turned off.

Next, at the step 63, whether a destination call button is flashing is determined, so as to ascertain the existence of the recognized command. If a destination call button is flashing, then at the step 64, the recognized result is sent to the elevator control unit 20 as the command input while the flashing of the destination call button is changed to steady lighting, and the process of command input is terminated, whereas otherwise, the process simply terminates.

Thus, according to this embodiment, it is possible to provide a command input device for a voice controllable elevator system, capable of enabling a user to perform a command input in voice more easily and accurately, since the command input can be achieved by simply approaching the microphone, specifiying a desired destination in voice, and going away from the microphone, which is largely similar action to that required for the command input in a conventional elevator system, except that the manual pressing of the buttons is replaced by uttering of the commands. Moreover, in the process of such a command input, the recognized command is indicated by the flashing of the destination call button, and when an error is detected by the inspection, a correction can be made by simply repeating the same procedure.

It is to be noted that the user detection sensor 6 of diffusive reflection type can be replaced by other types of sensor such as a floor mattress type sensor, photoelectric sensor, or ultrasonic sensor.

Also, the indication of the recognized command by means of the flashing of the destination call button may be replaced by displaying of a message such as "second floor is registered" on a display screen, or vocalizing such a message through a speaker.

Furthermore, the method of the speech recognition is not limited to that described above, and any other speech recognition method may be substituted without affecting the essential feature of the present invention.

Besides these, many modifications and variations of the above embodiments may be made without departing from the novel and advantageous features of the present invention. Accordingly, all such modifications and variations are intended to be included within the scope of the appended claims.

What is claimed is:

1. A command input device for a voice controllable elevator system operated by an elevator control unit, comprising:

microphone means for receiving a voice command given by a user;

speech recognition means for recognizing the command;

sensor means for detecting the presence of the user within a prescribed proximity range of the microphone means initiated by a motion of the user toward the microphone means; and command output means connected with the speech recognition means and the sensor means for outputting the command recognized by the speech recognition means to the elevator control unit of the elevator system, in response to a termination of a detection of the presence of the user by the sensor means caused by a motion of the user away from the microphone means to a location outside of the prescribed proximity range, the command output means determining the end of the command given by the user, to be outputted to the elevator control unit, according to the termination of the detection of the presence of the user by the sensor means.

2. The command input device of the claim 1, wherein the speech recognition means remains operative only while the sensor means detects the presence of the user, such that only a last command received by the microphone means while the sensor means is detecting the presence of the user is recognized by the speech recognition means.

3. The command input device of the claim 2, further comprising indicator means for indicating the command recognized by the speech recognition means to the user for inspection.

4. The command input device of the claim 3, wherein the indicating means visually indicates the command recognized by the speech recognition means.

5. The command input device of the claim 4, wherein the the command given by the user is a desired destination, and wherein the indicating means comprises destination call buttons, where the command recognized by the speech recognition means is indicated by the flashing of one of the destination call buttons corresponding to the command.

6. The command input device of the claim 3, wherein the indicating means indicates in sound the command recognized by the speech recognition means.

7. The command input device of the claim 3, wherein the microphone means and the speech recognition means are operative only when the sensor means detects the presence of the user.

8. A command input device for a voice controllable elevator system operated by an elevator control unit, comprising:

microphone means for receiving a voice command given by a user;

sensor means for detecting the presence of the user with a prescribed proximity range of the microphone means initiated by a motion of the user toward the microphone means, where the microphone means is operative only when the sensor means detect the presence of the user and becomes inoperative when detection of the presence of the user by the sensor means is terminated by a motion of the user away from the microphone means to outside of the prescribed proximity range;

speech recognition means for recognizing the command, which remains operative only during a period of time in which the microphone means is operative, such that only a last command received by the microphone means while the microphone means is operative is recognized by the speech recognition means; and means for outputting the command recognized by the speech recognition means to the elevator control unit of the elevator system.

9. The command input device of the claim 8, wherein the outputting means outputs the command in response to the termination of a detection of the presence of the user by the sensor means.

10. The command input device of the claim 8, further comprising indicator means for indicating the command recognized by the speech recognition means to the user for an inspection.

11. The command input device of the claim 10, wherein the indicating means visually indicates the command recognized by the speech recognition means.

12. The command input device of the claim 11, wherein the the command given by the user is a desired destination, and wherein the indicating means comprises destination call buttons, where the command recognized by the speech recognition means is indicated by the flashing of one of the destination call buttons corresponding to the command.

13. The command input device of the claim 10, wherein the indicating means indicates in sounds the command recognized by the speech recognition means.

* * * * *